United States Patent [19]

Kane

[11] Patent Number: 4,827,840

[45] Date of Patent: May 9, 1989

[54] CAN CRUSHER

[76] Inventor: Robert J. Kane, 411 N. Pine St., Gardner, Ill. 60424

[21] Appl. No.: 122,691

[22] Filed: Nov. 2, 1987

Related U.S. Application Data

[63] Continuation of Ser. No. 917,149, Oct. 9, 1986, abandoned.

[51] Int. Cl.[4] ..... B30B 9/32

[52] U.S. Cl. ..... 100/280; 100/902; 241/99

[58] Field of Search ..... 100/902, 240, 245, 215, 100/295, 283, 284, 285, 281, 280; 241/99

[56] References Cited

U.S. PATENT DOCUMENTS

| | | | |
|---|---|---|---|
| 3,659,520 | 5/1972 | Garrett et al. | 100/902 X |
| 3,916,780 | 11/1975 | Heiser | 100/902 X |
| 4,240,341 | 12/1980 | Whipple et al. | 100/902 X |
| 4,550,658 | 11/1985 | Trolle | 100/902 X |

FOREIGN PATENT DOCUMENTS

| | | | |
|---|---|---|---|
| 167100 | 10/1983 | Japan | 100/902 |
| 853315 | 11/1960 | United Kingdom | 100/902 |

*Primary Examiner*—Mark Rosenbaum
*Attorney, Agent, or Firm*—Ernest Kettleson

[57] ABSTRACT

A can crusher comprising a vertical hopper to receive empty cans laid horizontally in a vertical stack one above the other, with the bottton can in the stack being positioned in end-to-end registration with a plunger head which reciprocates horizontally between a withdrawn position out of contact with the bottom can and an extended position to crush and compress the bottom can. When the plunger is withdrawn, the crushed can drops through a discharge opening just large enough for the compressed can to drop through but small enough to prevent an uncrushed can from falling through. The crushed can drops into a container placed below the discharge opening, and the next can in the vertical stack falls in place in registration with the plunger for crushing. The plunger head is moved between its withdrawn and extended positions by a drive rod pivotally connected to an intermediate portion of a lever which in turn is pivotally connected at one end to a pivot pin mounted in front of the vertical hopper. A pair of glide members project rearwardly from the bottom of the plunger head to slide on a horizontally extending guide-way having an elongated slot to receive a downwardly extending guide tab of the plunger head to guide the plunger into crushing engagement with a can when moved forward to its extended position. The forward end of the guideway terminates at the discharge opening for the compressed cans to fall through.

6 Claims, 3 Drawing Sheets

CAN CRUSHER

This application is a continuation of prior application Ser. No. 917,149, filed Oct. 9, 1986, now abandoned.

BACKGROUND OF THE INVENTION

This invention relates to the field of devices for crushing or compressing metal cans for recycling or reprocessing of the metal, and in particular to one which provides a self-feed hopper to receive a plurality of empty cans and to automatically by gravity alone place succeeding ones in position for crushing as each crushed can is automatically, and again by gravity alone, dropped through a discharge outlet into a receptacle or container for the crushed cans.

A number of prior art devices are known which are able to crush individual cans, and a few are known which provide a hopper for a number of empty cans but require a special mechanism of some type in order to place succeeding cans in position for crushing. Examples of prior art can crushing devices include those disclosed in the following United States patents:

U.S. Pat. No. 4,394,834 discloses a hand operated crushing device for crushing individual cans fed into the device by hand, one at a time.

U.S. Pat. No. 4,345,518 discloses another crushing device to crush individual cans fed by hand, one at a time.

U.S. Pat. No. 4,296,683 discloses a motor operated can crushing device having a hopper for a number of cans, in which the can to be crushed rests in a cradle that pivots as well as moves rearward while a sprocket wheel drives a ram compressing the can against an end plate, after which the cradle moves back forward into position.

U.S. Pat. No. 4,188,875 discloses a manually operated crushing device for cans fed into the device by hand, one at a time.

U.S. Pat. No. 4,108,065 discloses a can compactor in which several cans can be placed on an inclined ramp for feeding into position in registration with a ram, the mechanism for preventing a succeeding can from moving into such position until the previous can has been flattened including the upper edge of the ram head and an upwardly inclined plate having a secondary stop provided thereon. The can compactor disclosed in this patent flattens the side wall of the cans rather than compressing end-to-end as in the present invention.

U.S. Pat. No. 4,088,072 discloses a can crusher of the single feed type, one can at a time, with no hopper to automatically feed succeeding cans in place for crushing.

U.S. Pat. No. 3,857,334 discloses a crushing machine for containers which also dispenses tokens. The side wall of the cans is flattened in this device rather than compressing the cans end-to-end, whereby the cylindrical cans are free to roll into the feeding rotor which eventually positions individual cans in registration with the flattening ram.

U.S. Pat. No. 3,817,169 discloses a can crusher having a feed mechanism whereby the cans can roll up to the station adjacent to the crushing chamber whereupon they are fed into the chamber by one or more pivoting fingers arranged between adjacent, spaced apart rods which form a can supporting surface.

U.S. Pat. No. 3,062,130 discloses another can crusher in which the cans are free to roll up to the station adjacent the crushing chamber and are fed into the crushing chamber by action of a solenoid which causes a retaining arm on which the can rests to rotate thus dropping the can into the crushing chamber.

U.S. Pat. No. 2,178,461 discloses a machine for crushing cans in which cans are free to roll down a chute where they are eventually engaged by a star wheel and ratchet mechanism which holds the next can for crushing out of the crushing station until the ratchet mechanism is actuated by depressing a foot lever which thereby moves the next can into position for crushing.

The present invention overcomes the problem of prior art devices which require a mechanism of some type to keep succeeding cans from getting into the crushing chamber or crushing station and to then feed the next succeeding can into position after the preceding one has been crushed. The present invention does not require any such mechanism. The design of the ram guide-way and termination of its forward end at the discharge opening which is long enough in the longitudinal dimension to permit crushed or compressed cans to pass through but too short for the original uncompressed cans to pass through, keeps the can which is in position to be crushed in place to support the next succeeding can resting on top from falling into the crushing station until the upper edge of the ram head and the upper edge of its push rod have begun to pass under the next succeeding can whereupon it then rests on the upper edges of the ram head and of its push rod while the can below is being crushed, and until the ram head is withdrawn far enough to clear the can above whereupon it automatically drops into the crushing station in registration with the ram head when it is moved forward to its extended compressing position. The ram head is constructed and mounted in such way that its upper edge is able to clear the can resting on top of the can in position to be crushed, and the upper edge of its push rod is substantially even with the upper edge of the ram head for the can above to rest thereon and be supported thereby while the can below is being crushed. The can above is prevented from being drawn rearwardly by any frictional force when the ram head and its push rod are withdrawn from the extended or compressing position by a restraining front wall of the vertical hopper or chute.

SUMMARY OF THE INVENTION

It is an object of the invention to provide a can crusher having a hopper to receive a plurality of empty cans for crushing in which successive cans can be fed into the crushing station automatically without any external feeding mechanism or force after the preceding can has been crushed and discharged from the crushing station.

It is an object of the invention to provide a can crusher having a hopper to receive a plurality of empty cans for crushing in which a discharge aperture of reduced size is provided, large enough for crushed cans to pass through but small enough to prevent successive cans from falling through until they have been crushed.

It is an object of the invention to provide a can crusher which has a crushing mechanism that is able to target only the particular can to be crushed without the need for any other mechanism to keep other cans in a hopper from being unintentionally compressively contacted by the crushing mechanism.

It is an object of the invention to provide a can crusher having a hopper to receive a plurality of empty cans for crushing in which the hopper has a vertically extending chamber from an opening at the upper end to receive the cans to a crushing station at the lower end, and in which the vertically extending chamber is unobstructed from its upper end to its lower end except for the empty cans placed therein for crushing when they reach the crushing station at the lower end.

It is an object of the invention to provide a can crusher having a hopper to receive a plurality of empty cans for crushing in which the crushing mechanism includes a ram having a compressive contact surface corresponding in dimension and configuration to that of the facing portion of a can in the crushing station to be crushed to avoid any unintended compressive contact with a next succeeding can alying against and touching the can in the curshing staion.

It is an object of the invention to provide a can crusher having a hopper to recieve a plurality of empty cans for crushing in which the crushing mechanism includes a ram having a compressive contact surface with a dimension at least as great as that of the facing portion of a can in the crushing station to be crushed, having in addition a drive mechanism to position the compressive contact surface of the ram at an angle relative to the facing portion of the can to be crushed such that the edge of the ram closest to a next succeeding can in the hopper which is in touch with the can in the crushing station will be spaced apart from such next succeeding can and avoid contact therewith until after initial compressive contact has been made with the can in the crushing station and after the ram has proceeded forward towards its extended, compressing position beyond the plane of the facing portion of the can in the crushing station.

DESCRIPTION OF PREFERRED EMBODIMENT

Figure 1:
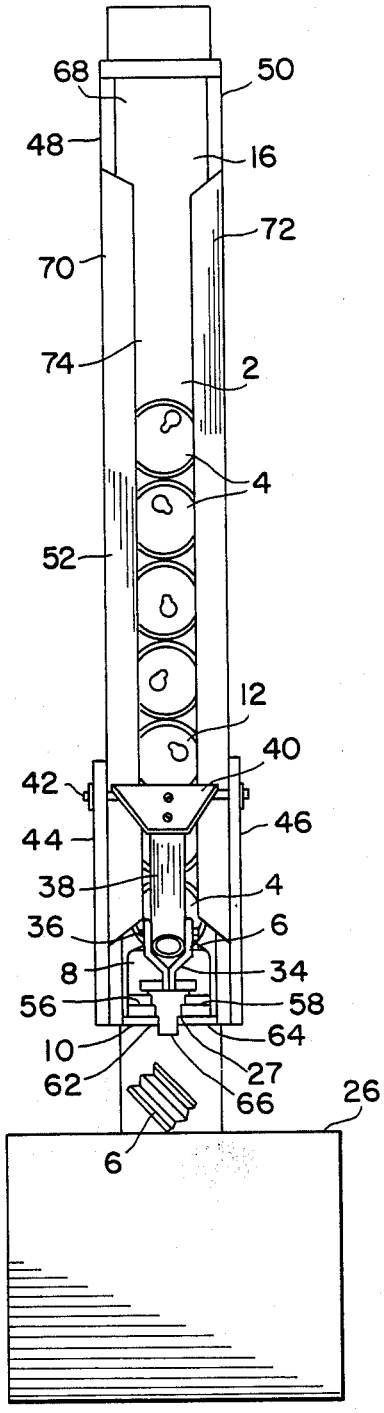
FIG. 1 is an elevation view of the front of a can crusher in accordance with this invention.
Figure 2:
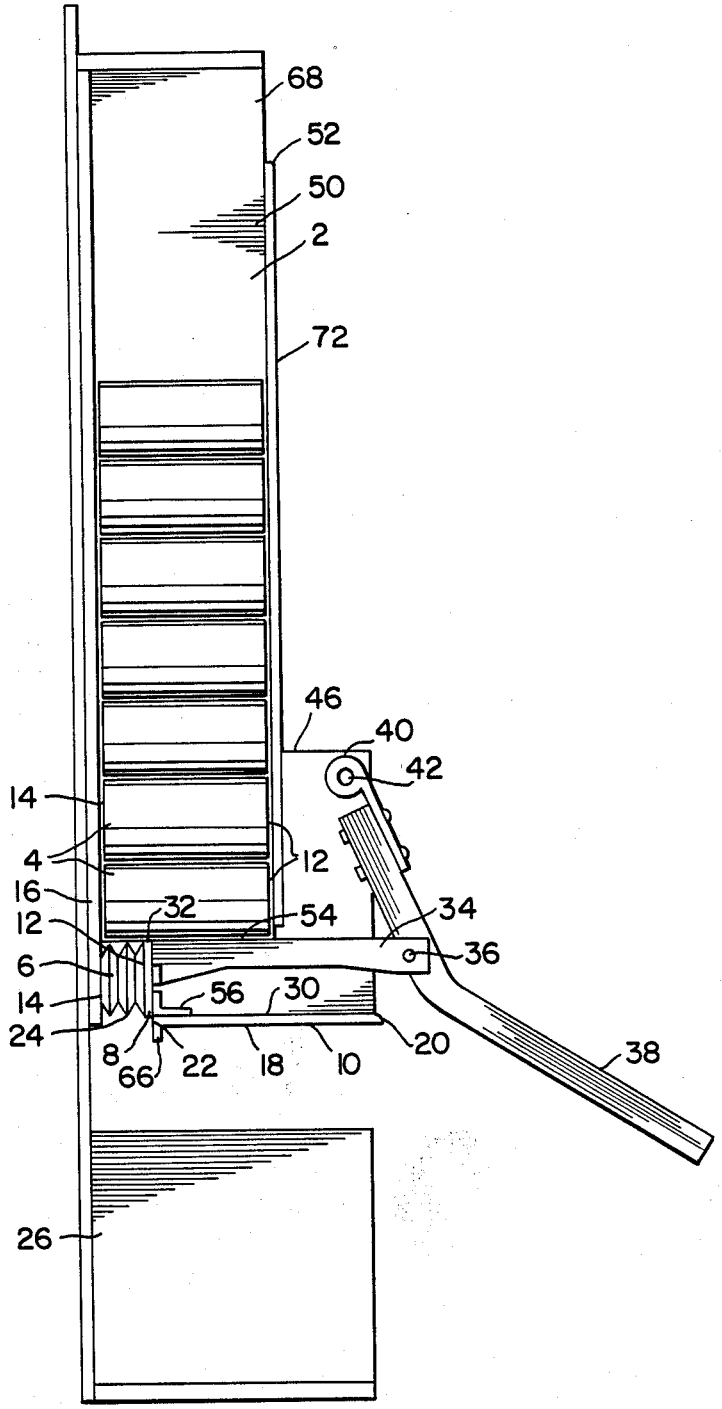
FIG. 2 is a side elevation view of the can crusher shown in FIG. 1 with the left side wall removed, and showing the ram in its extended, compressing position.
Figure 3:
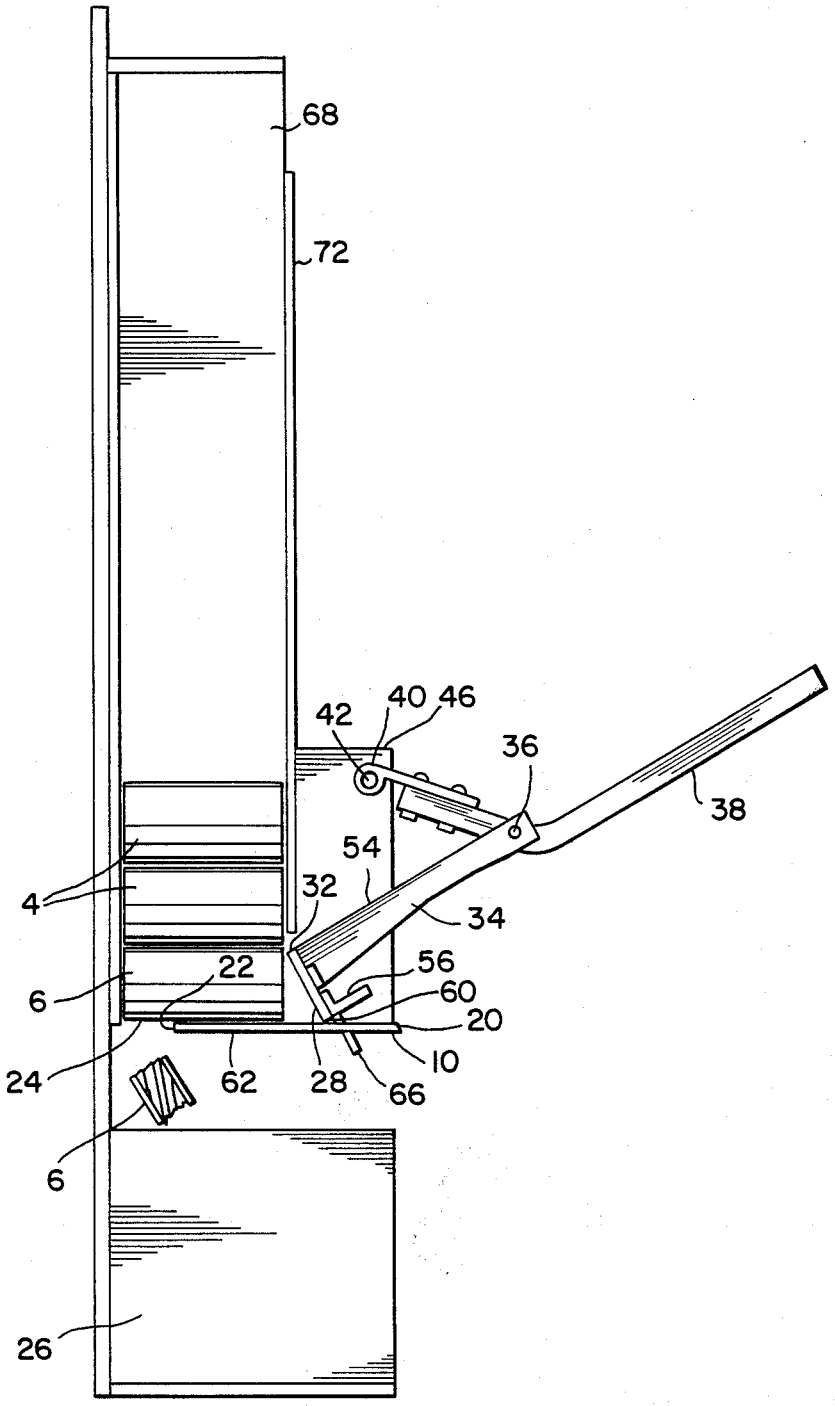
FIG. 3 is a side elevation viiew of the can crusher shown in FIG. 1 with the left side wall removed, and showing the ram in its retracted position with the upper edge of the ram below the surface of the can above at the point of initial compressive contact with the can below in the crushing station.

A can crusher in accordance with the present invention includes a vertically extending hopper 2 to receive a plurality of empty cans 4 laid horizontally in a vertical stack one above the other. The bottom can 6 is positioned in end-to-end registration with a plunger head or ram 8 which reciprocates horizontally between a withdrawn or released position and an extended or compressing position along a horizontally extending guide-way or track 10 which forms the bottom wall of the hopper 2.

In the withdrawn or released position, the ram 8 is out of contact with the bottom can 6. In the extended or compressing position, the ram 8 has contacted the facing end 12 of the bottom can 6 and pressed its remote end 14 against the back wall 16 of the hopper 2, compressing the can to a desired shorter longitudinal dimension.

The guide-way or track 10 comprises a flat metal plate 18 extending from a rearward end 20 to a forward end 22 terminating at a spaced apart distance from the back wall 16 of the hopper 2, such spaced apart distance forming a discharge aperture 24 having a longitudinal dimension corresponding to the longitudinal dimension of a compressed bottom can 6. In other words, the discharge aperture 24 has a longitudinal dimension large enough to permit a compressed bottom can 6 to drop through, but small enough to prevent a bottom can 6 from falling through until it has been compressed.

A crushed can receptacle 26 is placed below the discharge aperture 24 to receive the crushed cans when they drop through.

The next succeeding empty can 4 above the bottom can 6 which has been crushed automatically falls into place for crushing by gravity alone when the crushed can drops through the discharge aperture 24 and the ram 8 is withdrawn from its extended position.

The guide-way or track 10 includes a centrally located elongated slot extending from its rearward end 20 to its forward end 22. The plunger head or ram 8 includes a flat planar bearing surface 28 for bearing contact against the facing end 12 of a bottom can 6, having a width and height dimension corresponding to that of the facing end 12 of a bottom can 6. The height dimension may be slightly less than the corresponding height or vertical dimension of the bottom can 6 to avoid contact with the can 4 which is above and resting on the bottom can 6 when the plunger head or ram 8 is moved to its extended compressing position.

In the alternative, the height dimension of the bearing surface 28 of the ram or plunger head 8 may be at least as great as the corresponding height or vertical dimension of the facing end 12 of bottom can 6, in which case the ram or plunger head 8 is positioned at an oblique angle relative to the surface 30 of the flat metal plate 18 comprising the guide-way 10 at the moment of initial impact with the facing end 12 of bottom can 6, and at an oblique angle also relative to the vertically extending facing end 12 of can 6 at such point in the forward movement of the plunger head or ram 8. That way the upper edge 32 of the bearing surface 28 of ram 8 is below the facing end 12 of the next succeeding can 4 in the hopper 2 above and resting on the bottom can 6 until the bearing surface 28 has passed under and beyond such facing end 12 of can 4 during forward movement of the ram 8. As the ram 8 moves forward beyond such point its bearing surface 28 is pivotally moved from such oblique angle position into a substantially right angle position relative to the surface 30 of the guide-way 10 and substantially parallel to the facing end 12 of the bottom can 6 to bear flush thereagainst during the remainder of its foward movement to the fully extended compressing position of the ram 8.

A push rod or drive rod 34 extends from the ram or plunger head 8 rearwardly for pivotal connection to an intermediate point 36 of a lever 38, having a connecting end 40 pivotally received on pivot pin 42 supported between side wall extensions 44 and 46 positioned adjacent side walls 48 and 50 respectively of the hopper 2, the pivot pin 42 being spaced apart above the guide-way 10 and in front of the front wall 52 of the vertical hopper 2 at a point in substantial vertical alignment with the rearward end 20 of the guide-way 10. The intermediate point 36 for pivotal connection of push rod 34 to lever 38 is selected inward from the lever connecting end 40 a distance sufficient for push rod 34 to extend at an oblique angle to the surface 30 of guide-way 10 to also position the bearing surface 28 of the ram 8 at its aforesaid oblique angle thereto at the point of initial impact with the facing end 12 of bottom can 6. The drive rod 34 extends rearwardly from the plunger head 8 on a line that is substationally normal to the plane of the planar bearing surface 28 of the ram or plunger head 8. As the lever 38 is pushed downwardly, it drives the push rod 34 forward while at the same time reducing the angle between the push rod 34 and the surface 30 of the guide-way 10 until the push rod 34 is substantially parallel to surface 30 at which time bearing surface 28 of the ram 8 is substantially parallel to the facing end 12 of bottom can 6 and in full bearing engagement thereagainst.

The upper edge 54 of the push rod 34 extends rearwardly from the bearing surface 28 of the ram 8 at substantially the same level as the upper edge 32 of bearing surface 28 whereby the next succeeding can 4 in hopper 2 above the bottom can 6 being crushed rests on the upper edge 54 of push rod 34 as well as on the upper edge 32 of bearing surface 28 of the ram 8 when such bearing surface 28 of ram 8 is in crushing and compressing engagement with the bottom can 6. Thus, the next succeeding can 4 is held out of the position for crushing until the bottom can 6 has been crushed or compressed sufficiently to drop through the discharge aperture 24 and the ram 8 has been completely withdrawn to a position behind the facing end 12 of the next succeeding can 4. That can is then free to drop down on the guide-way 10, automatically and by gravity alone, into registration with the bearing surface 28 of ram 8 for crushing.

The ram or plunger head 8 includes a pair of trailing glide members 56 and 58 projecting rearwardly from the bottom edge 60 of the bearing surface 28, to slide on the track portions 62 and 64 on each side of the elongated slot 27 of the guide-way 10. The ram or plunger head 8 also includes a depending guide tab 66 which extends downwardly from the bottom edge 60 and is received in the elongated slot 27. The guide tab 66 keeps the plunger head or ram 8 and its bearing surface 28 directed toward the facing end 12 of the bottom can 6 as it is moved forwardly from the withdrawn position to the extended compressing position. The bearing surface 28 extends slightly beyond the forward end 22 of the guide-way 10 and projects outwardly over the discharge aperture 24 a short ways when the plunger head or ram 8 is in its fully extended or compressing position. This enables compressing the bottom can 6 somewhat more than enough for it to drop through the discharge aperture 24 automatically and by gravity alone as soon as the bearing surface 28 and ram 8 is withdrawn from the facing end 12 of the bottom can 6. The trailing glide members 56 and 58 support the plunger head 8 on the guide-way 10 when its bearing surface is projected beyond the forward end 22 thereof.

The front wall 52 of the vertical hopper 2 is open at its upper end 68 to receive empty cans 4. A pair of retaining strips 70 and 72 are secured to the respective side walls 48 and 50. The retaining strips 70 and 72 extend inwardly from their respective side walls across a portion of the front wall 52, leaving a central gap 74 extending downwardly from the opening at the upper end 68 of the vertical hopper terminating at a point just above the bottom can 6 resting on the guide-way 10 in position for crushing. The central gap 74 is wide enough to permit a workman to extend his hand and fingers through to reach cans 4 stacked therein if necessary to push upwardly for removal or for any other purpose.

The side walls 48 and 50 of the hopper 2 are spaced apart a distance corresponding to the outer diameter of the empty cans 4 and just sufficiently larger to enable the cans 4 placed therein horizontally to drop freely as succeeding lower cans are crushed. The front wall 52 and back wall 16 of hopper 2 are spaced apart a distance corresponding to the longitudinal dimension of the empty cans 4 and just sufficiently larger to enable the horizontally stacked cans 4 to drop freely.

In operation, empty cans 4 are placed horizontally through the open upper end 68 of hopper 2, whereupon they drop toward the bottom comprising guide-way 10 and the reduced dimension discharge aperture 24, the cans 4 resting therein horizontally one on top of the other, their facing ends 12 facing in the direction of the front wall 52 and their remote ends facing the back wall 16. A bottom can 6 rests on the forward portion of the guide-way 10 in registration with the bearing surface 28 of the ram or plunger head 8 for crushing.

The ram or plunger head 8 at such time is resting on the guide-way 10 in its withdrawn position, its bearing surface 28 at an oblique angle to the surface 30 of the guide-way 10. The lever 38 is then moved downwardly which in turn moves the push rod 34 forwardly with a simultaneously pivotal or rotational movement which begins to reduce its oblique angle with the guide-way 10 and begins to increase the oblique angle of the bearing surface 28 with the guide-way 10. While still at an oblique angle which positions the upper edge 32 of bearing surface 28 below the level of the can 4 resting on top of the bottom can 6, the bearing surface 28 engages the facing end 12 of the bottom can 6 as the ram 8 is moved forward and begins to compress the bottom can 6 against the back wall 16 of the vertical hopper 2. Once past the facing end 12 of the can 4 next above the bottom can 6, the push rod 34 is moved by the lever 38 forwardly and rotationally to an ever decreasing angle with the guide-way 10 while the bearing surface 28 compressing against the bottom can 6 is moved forwardly and rotationally to an ever increasing angle relative to the guide-way 10 until it is at a substantially ninety degree angle thereto and at such time substantially flush against the facing end 12 of the bottom can 6 for maximum application of compressing force.

The lever 38 is forced downwardly until the push rod 34 has moved the ram 8 into its fully extended compressing position, wherein its bearing surface 28 projects a short distance over the discharge aperture 24 to compress the bottom can 6 sufficiently for it to readily drop through the discharge aperture 24 into the crushed can receptacle 26. The trailing glide members 56 and 58 support the plunger head or ram 8 on the guide-way 10 while its bearing surface 28 projects outwardly beyond the forward end 22 of guide-way 10 and over the discharge aperture 24.

The lever 38 is then lifted upwardly to draw the push rod 34 and ram 8 rearwardly to its withdrawn position at which time the bearing surface 28 of ram 8 is drawn rearwardly of the facing end 12 of the next succeeding empty can 4, whereupon it is free to drop automatically by gravity alone into position as bottom can 6 resting on guide-way 10 in registration with the plunger head or ram for crushing.

The process is repeated by raising and lowering the lever 38, each bottom can 6 dropping automatically by gravity alone through the discharge aperture 24 into the crushed can receptacle 26 and each succeeding can 4 next above also dropping automatically by gravity alone into position as bottom can 6 for crushing when the ram 8 is moved rearwardly into its withdrawn or retracted position.

I claim:

1. A can crusher comprising crushing means, a hopper to receive a plurality of empty cans for crushing, a crushing station positioned to receive successive cans for crushing from said hopper, said crushing station comprising a horizontally extending floor having a planar upwardly facing surface and an unobstructed space until occupied by a can to be crushed, said unobstructed space extending upwardly from said floor a distance corresponding to the cross-sectional dimension of a said can to be crushed when received in said crushing station for crushing, an unobstructed passageway leading from said hopper to said crushing station whereby a successive can in said hopper automatically moves freely into said crushing station and on to said planar floor thereof after a preceding can has been crushed and discharged from said crushing station, including said successive can and said preceding can, said successive can being above and bearing down directly and unimpeded against said preceding can while said preceding can is in said crushing station, said successive can and said preceding can each having a forwardly facing and a rearwardly facing end wall, said forwardly facing end wall of each being held in substantially planar alignment while said preceding can is being crushed by said crushing means bearing against its said rearwardly facing end wall to compress it toward its forwardly facing end wall, said successive can moving through said unobstructed passageway into said unobstructed space of said crushing station and on to said planar floor thereof responsive to said preceding can being discharged therefrom as said crushing means is drawn rearwardly away from its said rearwardly facing end wall, said hopper extending vertically and upwardly from said crushing station, said hopper including spaced apart side walls, a forward end wall and a rearward end wall, the inwardly facing surfaces of said side walls being spaced apart a distance corresponding substantially to the diameter of cylindrical cans stacked therein one on top of another, said crushing station including a vertically extending abutment wall to serve as anvil means against which said preceding can in said crushing station is to be pressed by said crushing means, said vertically extending abutment wall being joined to said forward end wall of said hopper end in planar alignment therewith at its juncture with said forward end wall of said hopper to hold said forwardly facing end walls of said succeeding can and said preceding can in substantially planar alignment while said preceding can is being crushed, said floor of said crushing station having a forward end and a rearward end, said forward end facing toward said abutment wall and terminating at a point spaced apart therefrom to provide a discharge aperture for said preceding can to pass through after being crushed, said preceding can being discharged automatically through said discharge aperture by gravity alone after being crushed, wherein said crushing means includes a compressing member having a planar bearing surface facing toward said abutment wall, said compressing member having an upper edge and a lower edge, said lower edge being in sliding relationship with said horizontally extending floor, said compressing member being reciprocally movable between a retracted position adjacent said rearward end of said floor and an extended compressing position adjacent said forward end of said floor, drive means connected to said compressing member, the dimension of said bearing surface of said compressing member between said upper edge and said lower edge thereof being at least as great as the corresponding dimension of said rearwardly facing end wall of said preceding can in said crushing station against which compressive contact is to be made, including positioning means to position said planar bearing surface of said compressing member at an oblique angle to said horizontally extending floor to lower said upper edge of said compressing member sufficiently below said next succeeding can in said hopper to avoid making compressive contact with said succeeding can at the moment said compressing member makes compressive contact against said preceding can in said crushing station, said positioning means thereafter positioning said compressing member in full facing contact with said rearwardly facing end wall of said preceding can and raising said upper edge of said compressing member upwardly toward the downwardly facing surface of said next succeeding can as it continues toward said abutment wall compressing said preceding can in said crushing station as it goes.

2. A can crusher as set forth in claim 1, wherein said positioning means comprises said horizontally extending floor of said crushing station and said drive means connected to said crushing member, said horizontally extending floor supporting said lower edge of said compressing member in the same horizontal plane throughout the entire movement of said compressing member between its said retracted and extended positions, said drive means being connected to said compressing member to lower said upper edge of said compressing member as it moves toward its said retracted position and to raise said upper edge of said compressing member as it moves toward its said extended position.

3. A can crusher as set forth in claim 2, wherein said rearwardly facing end wall of said preceding can when in said crushing station with its forwardly facing end wall against said vertically extending abutment wall of said crushing station is in line with a contact point on said horizontal floor of said crushing station, said drive means being connected to said compressing member to lower and position said upper edge of said compressing member at a level below the top of said preceding can and below the bottom of said successive can resting on said preceding can when said upper edge of said compressing member is in line with said contact point on said horizontal floor.

4. A can crusher as set forth in claim 2, wherein said drive means includes a first elongated member having a first end and an opposite second end, said first elongated member extending rearwardly from said compressing member and being rigidly secured thereto at said first end, a second elongated member having a pivot end and an opposite free end, said pivot end being pivotally connected to said can crusher at a point above said horizontal floor of said crushing station for pivotal movement in an arc toward and away from the said rearward end of said horizontal floor of said crushing station, said second end of said first elongated member being pivotally connected to said second elongated member at a preselected location between its said pivot end and its said free end, whereby said first elongated member moves said compressing member in a straight horizontal line along said horizontal floor of said crushing station between said extended and retracted positions with its lower edge in sliding frictional contact with said horizontal floor throughout such movement as said second elongated member is pivoted toward and away from said rearward end of said horizontal floor of said crushing station, the said upper edge of said compressing member being thereby raised as it is moved forwardly to the extended position and lowered as it is moved toward the retracted position.

5. A can crusher as set forth in claim 2, wherein said horizontal floor of said crushing station includes an elongated guide slot extending longitudinally thereof, said compressing member includes a guide tab extending from its said lower edge received in said guide slot extending longitudinally thereof, said compressing member includes a guide tab extending from its said lower edge received in said guide slot to guide said compressing member in a straight line while being reciprocated between its said retracted and extended positions.

6. A can crusher as set forth in claim 5, wherein said compressing member includes a glide member extending from its said lower edge and rearwardly thereof for sliding engagement with said horizontal floor of said crushing station as said compressing member is reciprocated between its said retracted and extended positions.

* * * * *